US007198016B2

(12) United States Patent
Burke

(10) Patent No.: US 7,198,016 B2
(45) Date of Patent: Apr. 3, 2007

(54) VEHICLE WITH SWITCHED SUPPLEMENTAL ENERGY STORAGE SYSTEM FOR ENGINE CRANKING

(75) Inventor: James O. Burke, Richmond, IL (US)

(73) Assignee: Kold Ban International, Ltd., Lake In The Hills, IL (US)

( * ) Notice: Subject to any disclaimer, the term of this patent is extended or adjusted under 35 U.S.C. 154(b) by 0 days.

(21) Appl. No.: 11/244,461

(22) Filed: Oct. 5, 2005

(65) Prior Publication Data

US 2006/0201467 A1 Sep. 14, 2006

Related U.S. Application Data

(62) Division of application No. 10/798,237, filed on Mar. 11, 2004, now Pat. No. 6,988,476.

(51) Int. Cl.
*F02N 11/08* (2006.01)
*F02N 1/00* (2006.01)

(52) U.S. Cl. ..... 123/179.3; 290/38 R

(58) Field of Classification Search ..... 123/179.1, 123/179.3; 290/38 R, 38 C, 38 D
See application file for complete search history.

(56) References Cited

U.S. PATENT DOCUMENTS

| | | | |
|---|---|---|---|
| 2,659,042 | A | 11/1953 | Anderson |
| 3,638,108 | A | 1/1972 | Channing |
| 3,942,027 | A | 3/1976 | Fima |
| 4,161,682 | A | 7/1979 | Corvett |
| 4,488,147 | A | 12/1984 | Signorile |
| 4,492,912 | A | 1/1985 | Nowakowski |
| 4,494,162 | A | 1/1985 | Eyler |
| 4,510,431 | A | 4/1985 | Winkler |
| 4,540,929 | A | 9/1985 | Binkley |
| 4,727,306 | A | 2/1988 | Misak et al. |
| 4,857,820 | A | 8/1989 | Tompkins et al. |

(Continued)

FOREIGN PATENT DOCUMENTS

| | | |
|---|---|---|
| JP | 2-175351 | 7/1990 |

OTHER PUBLICATIONS

Miller et al., SAE Technical Paper Series 982794 entitled "Truck Starting Using Electrochemical Capacitors," copyrighted 1998, pp. 1-7.

(Continued)

*Primary Examiner*—John T. Kwon
(74) *Attorney, Agent, or Firm*—Brinks Hofer Gilson & Lione

(57) ABSTRACT

An engine cranking system includes an engine, a cranking motor coupled to the engine, a battery, a capacitor and an ignition switch. A first relay is connected between the cranking motor and system ground. A second relay is moveable between at least an open-circuit condition and a closed-circuit position to complete an electrical path connecting the capacitor with the cranking motor. The first relay is connected between the capacitor and the second relay. In one embodiment, a running engine sensory component is coupled between the first relay and system ground. In another embodiment, the engine cranking system includes a running engine sensory component connected to a relay and a control module connected to the relay and the capacitor. In one embodiment, a momentary switch is coupled between the capacitor and the relay.

11 Claims, 8 Drawing Sheets

U.S. PATENT DOCUMENTS

| | | | | |
|---|---|---|---|---|
| 4,902,955 | A | 2/1990 | Manis et al. | |
| 5,039,930 | A | 8/1991 | Collier et al. | |
| 5,077,513 | A | 12/1991 | Dea et al. | |
| 5,146,095 | A | 9/1992 | Tsuchiya et al. | |
| 5,155,373 | A | 10/1992 | Tsuchiya et al. | |
| 5,157,267 | A | 10/1992 | Shirata et al. | |
| H1172 | H | 4/1993 | Gorniak | |
| 5,207,194 | A | 5/1993 | Clerici | |
| 5,260,637 | A | 11/1993 | Pizzi | |
| 5,321,389 | A | 6/1994 | Miester | |
| 5,371,455 | A | 12/1994 | Chen | |
| 5,563,454 | A | 10/1996 | Araki et al. | |
| 5,589,292 | A | 12/1996 | Rozon | |
| 5,637,978 | A | 6/1997 | Kellet et al. | |
| 5,642,696 | A | 7/1997 | Matsui | |
| 5,783,872 | A | 7/1998 | Blair | |
| 5,793,185 | A | 8/1998 | Prelec et al. | |
| 5,818,115 | A | 10/1998 | Nagao | |
| 5,925,938 | A | 7/1999 | Tamor | |
| 5,963,417 | A | 10/1999 | Anderson et al. | |
| 5,998,961 | A | 12/1999 | Brown | |
| 6,018,199 | A | 1/2000 | Shiroyama et al. | |
| 6,034,492 | A | 3/2000 | Saito et al. | |
| 6,057,667 | A | 5/2000 | Mills | |
| 6,075,331 | A | 6/2000 | Ando et al. | |
| 6,130,519 | A | 10/2000 | Whiting et al. | |
| 6,133,645 | A | 10/2000 | Scribner et al. | |
| 6,160,373 | A | 12/2000 | Dunn et al. | |
| 6,163,088 | A | 12/2000 | Codina et al. | |
| 6,211,577 | B1 | 4/2001 | Alksnat et al. | |
| 6,212,054 | B1 | 4/2001 | Chan | |
| 6,222,342 | B1 | 4/2001 | Eggert et al. | |
| 6,242,887 | B1 | 6/2001 | Burke | |
| 6,265,851 | B1 | 7/2001 | Brien et al. | |
| 6,325,035 | B1 | 12/2001 | Codina et al. | |
| 6,362,595 | B1 | 3/2002 | Burke | |
| 6,426,606 | B1 | 7/2002 | Purkey | |
| 6,679,212 | B2 | 1/2004 | Kelling | |
| 6,871,625 | B1 * | 3/2005 | Burke | 123/179.24 |
| 6,988,476 | B2 * | 1/2006 | Solberg | 123/179.3 |
| 2003/0075134 | A1 | 4/2003 | Burke | |
| 2005/0224035 | A1 * | 10/2005 | Burke et al. | 123/179.3 |

OTHER PUBLICATIONS

Miller, John R., "Engineering Battery Capacitor Combinations in High Power Applications: Diesel Engine Starting," presented at "The 9th International Seminar on Double Layer Capacitors and Similar Energy Storage Devices," Deerfield Beach, Florida, pp. 1-11, Dec. 6-8, 1999.

Charge All Wheel Type Battery Chargers (Model 13-012 Boost All, Good All Mfg. 1999).

The Intra Switch, Intra USA 1998.

Battery Optimizer, Purkey's Fleet Electric Inc. 1999.

Low Voltage Disconnects Switches and Alarms, Sure Power Industries Inc. 1998.

KBi, "KBi Kranking Kap Super Capacitors, " KBi Publication, 2000 2 pages.

"KAPower Super Capacitors, " Kold-Ban International, Ltd., brochures, 2000, 2 pages.

KBi, "KrankingKart Professional Jump-Start Unit," obtained at the internet address: http://www.koldban.com/mainpages.karts.htm, Aug. 30, 2001, 3 pages.

Capacitator Log, dated May 15, 2000, pp. 1-4.

Miller, John R., SAE Technical Paper Series 982794 entitled "Truck Starting Using Electrochemical Capacitors," copyrighted 1998, pp. 1-7.

Miller, John R., "Engineering Battery Capacitor Combinations in High Power Applications: Diesel Engine Starting," presented at "The 9th International Seminar on Double Layer Capacitors and Similar Energy Storage Devices," Deerfield Beach, Florida, pp. 1-11, Dec. 6-8, 1999.

KBi, "KBi Kranking Kap Super Capacitors," KBi Publication, 2000, 2 pages.

"KAPower Super Capacitors," Kold-Ban International, Ltd., brochures, 2000, 2 pages.

KBi, "KrankingKart Professional Jump-Start Unit," obtained at the internet address: http://www.koldban.com/mainpages.karts.htm, Aug. 30, 2001, 3 pages.

* cited by examiner 62
12
S TERM.
16
20
B TERM.
64
21
106
3
100
1
102
2
104
108
18
+
−
21
21
38
21
110
48
1
40
2
44
42
46
32
1
+
30
2
−
34
2
36

62
12
S TERM.
16
20
B TERM.
64
21
106
3
100
1
102
2
104
108
18
+
−
21
21
38
21
110
48
1
40
2
44
42
46
32
1
+
30
2
−
34
2
36

62
12
S
TERM.
16
20
B
TERM.
64
21
106
3
100
1
102
2
104
108
18
+
−
21
21
21
38
110
48
1
40
2
44
42
46
32
1
+
30
2
−
34
2
36

62
12
S TERM.
16
20
B TERM.
64
21
106
3
100
1
102
2
104
108
18
+
−
21
21
38
21
110
48
1
40
2
44
42
46
32
1
+
30
2
−
34
2
36

VEHICLE WITH SWITCHED SUPPLEMENTAL ENERGY STORAGE SYSTEM FOR ENGINE CRANKING

This application is a divisional of U.S. patent application Ser. No. 10/798,237, filed Mar. 11, 2004 now U.S. Pat. No. 6,988,476, the entire disclosure of which is hereby incorporated herein by reference.

BACKGROUND

The present invention relates to vehicles of the type that include an internal combustion engine, a cranking motor, and a battery normally used to power the cranking motor. In particular, this invention relates to improvements to such systems that increase of the reliability of engine starting.

A problem presently exists with vehicles such as heavy-duty trucks. Drivers may on occasion run auxiliary loads excessively when the truck engine is not running. It is not unusual for heavy-duty trucks to include televisions and other appliances, and these appliances are often used when the truck is parked with the engine off. Excessive use of such appliances can drain the vehicle batteries to the extent that it is no longer possible to start the truck engine.

Various systems have been developed that use a capacitor to supplement the vehicle batteries such that the vehicle can be started. Often, however, the capacitor is not completely isolated, and can lose its charge over time, for example by leaking through one or more diodes. In other systems, wherein the capacitor is completely isolated when not in use, the capacitor is also isolated from the one or more switches or relays used to connect the capacitor to the cranking motor, such that the capacitor cannot be used to close the switch or relay to bring the capacitor on line.

SUMMARY

In one aspect, an engine cranking system includes an engine operably moveable between a running condition and an off condition, a cranking motor coupled to the engine, a battery including first and second battery terminals, and a capacitor including first and second capacitor terminals. The first battery terminal is electrically coupled to the cranking motor and the second battery terminal is electrically coupled to a system ground. First and second electrical paths interconnect the first and second capacitor terminals, respectively, with the cranking motor and the system ground. An ignition switch is coupled between the first battery terminal and the cranking motor. The ignition switch completes an electrical path between the first battery terminal and the cranking motor when moved to a start position. A first relay is connected between the cranking motor and the system ground, and includes a first switched terminal and a second switched terminal. The first relay includes a switch moveable between a first position and a second position in response to a first control voltage being applied thereto by the battery when the ignition switch is moved to the start position. The first and second switched terminals are electrically connected when the first relay is moved to the second position.

A second relay is included in one of the first and second electrical paths and has a first control terminal and a second control terminal. The second relay is moveable between at least an open-circuit condition and a closed-circuit position in response to a second control voltage being applied thereto across the first and second control terminals. The second relay interrupts one of the first and second electrical paths when in the open-circuit position, and completes one of the first and second electrical paths when in the closed-circuit position. One of the first and second switched terminals of the first relay is coupled to one of the first and second capacitor terminals, the other of the first and second switched terminals of the first relay is coupled to one of the first and second control terminals of the second relay, and the other of the first and second capacitor terminals is coupled to the other of the first and second control terminals of the second relay.

In one preferred embodiment, the first relay includes a third switched terminal. The first and third switched terminals are electrically connected and the first and second switched terminals are electrically disconnected when the first relay is in the first position.

In one embodiment, the engine cranking system further includes a running engine sensory component coupled between the third switched terminal of the first relay and the system ground. The running engine sensory component completes the electrical path between the third switched terminal and the system ground and thereby maintains the second relay in the closed-circuit position when the engine is operated in the running condition. In one embodiment, the running engine sensory component includes a normally open oil pressure switch, wherein the normally open oil pressure switch is positionable in a closed position in response to at least a predetermined minimum oil pressure being applied thereto.

In one embodiment, the system further includes a momentary switch electrically coupled between one of the first and second capacitor terminals and one of the first and second control terminals of the second relay. The momentary switch is moveable between an open position and a closed position. The momentary switch completes the electrical path between one of the first and second capacitor terminals and one of the first and second control terminals of the second relay when in the closed position.

In another aspect, the engine cranking system includes a running engine sensory component having a first switched terminal, a second switched terminal and a third switched terminal. The running engine sensory component includes a switch moveable from a first position to a second position when the engine is operated in the running condition. The first and third switched terminals are electrically coupled when the switch is in the first position, and the first and second switched terminals are electrically coupled when the switch is in the second position. A control module is electrically coupled to each of the first and second control terminals of a relay, to at least one of the first and second capacitor terminals and to the system ground. The control module is operable to measure a voltage applied by the battery when the switch of the running engine sensory component is in the first position, and to electrically couple the capacitor with the relay if the voltage is greater than or equal to a minimum predetermined voltage. The control module is further operable to electrically couple the relay with one or all of the battery, alternator and/or capacitor when the switch of the running engine sensory component is in the second position.

In various embodiments, the system further includes a momentary switch electrically coupled between one of the first and second capacitor terminals and one of the first and second control terminals of the second relay. The momentary switch is moveable between an open position and a closed position. The momentary switch completes the electrical path between one of the first and second capacitor terminals and one of the first and second control terminals of the second relay when in the closed position. In another aspect, methods of starting the engine using the various embodiments of the system are provided.

The various preferred embodiments provide significant advantages over other engine cranking systems. In particular, the capacitor is completely isolated when the ignition switch is not in the start position. Accordingly, the capacitor cannot be inadvertently discharged, and it cannot leak over time, for example, through a diode. Moreover, the capacitor can be brought on line to close the relay, for example if the charge in the battery is insufficient, simply by closing the momentary switch. Accordingly, the system avoids inadvertent discharge while also making the capacitor available to close the relay.

This section has been provided by way of general introduction, and it is not intended to narrow the scope of the following claims.

DETAILED DESCRIPTION OF THE PREFERRED EMBODIMENTS

Figure 1:
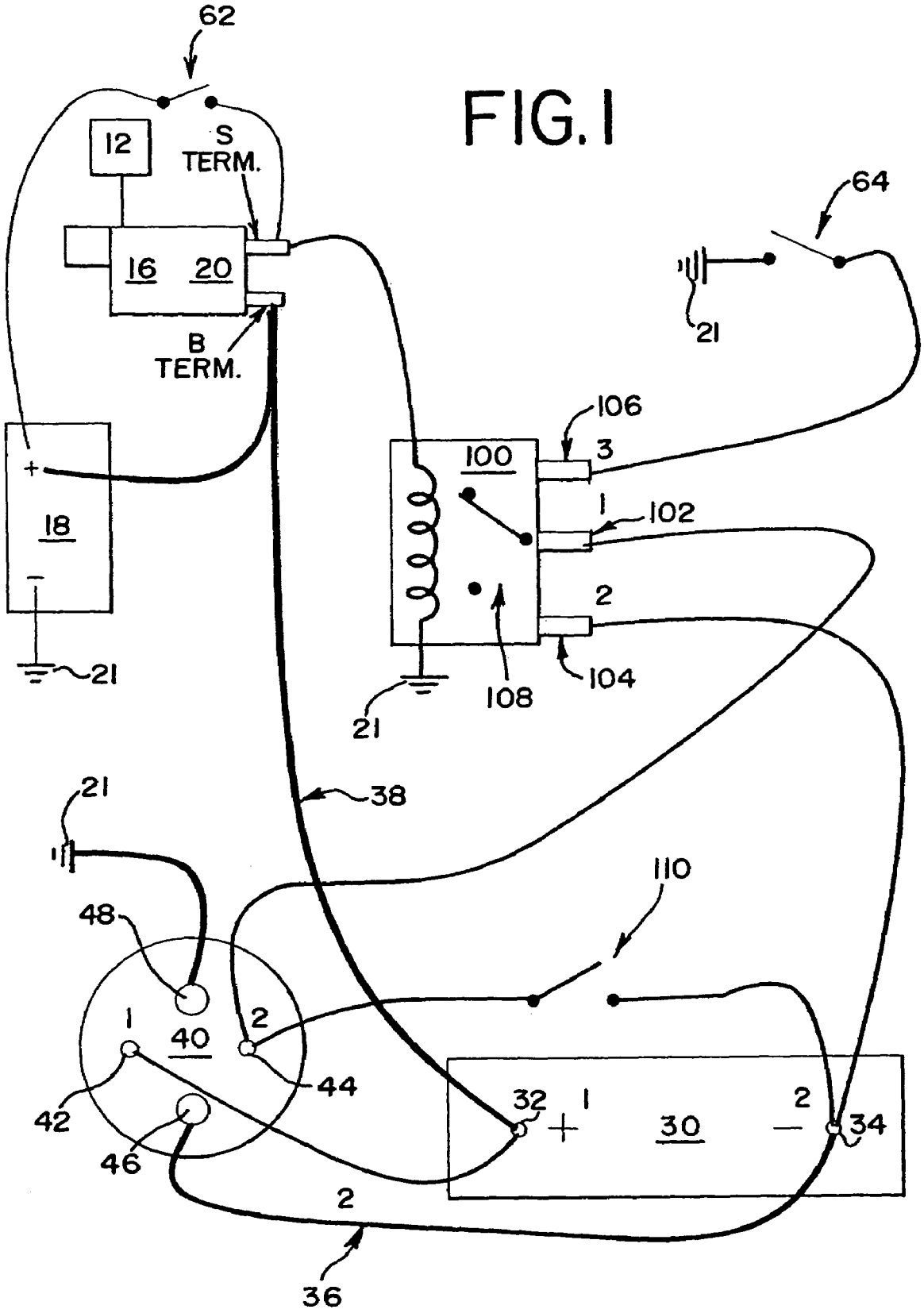
FIG. 1 is a schematic diagram of a first embodiment of a vehicle electrical system, showing an ignition switch in an open position, a first relay having a switch in a first position, a running engine sensory component in an open position and a momentary switch in an open position.

Turning down to the drawings, FIGS. 1–8 show various embodiments of an electrical system of a vehicle (not shown) that includes an internal combustion engine 12. The engine 12 can take any suitable form, and may for example be a conventional diesel or gasoline engine. The engine 12 is mechanically coupled to a cranking motor 16. The cranking motor 16 can take any suitable form, and it is conventionally an electrical motor that is powered during cranking conditions by current from one or more storage batteries 18 such as conventional lead-acid batteries. Current from the batteries 18 is switched to the cranking motor 16 via a switch such as a conventional solenoid switch 20. The solenoid switch is activated for example when an ignition switch 62 is moved to the start position. In operation, the engine is operably moved between a running condition and an off condition. A conventional ignition switch includes four positions: accessory, off, on/run, and start. Of course, in other embodiments, other switches having other positions can be used. In addition, in some embodiments, a switch can be positioned between at least an off and run position, and a separate push-button, crank switch is actuated to crank the motor. In such an embodiment, one or both of the off/run switch and the separate push-button switch are defined as an ignition switch, with the combined ignition switches being in the "start" position when the on/off switch is in the "on" position and the crank switch is in the engaged position.

All of the elements 12 through 20 described above may be entirely conventional, and are well-known to those skilled in the art. The present invention is well adapted for use with the widest variety of alternative embodiments of these elements.

In addition to the conventional electrical system described above, the vehicle also includes a supplemental electrical system including a capacitor 30. The capacitor 30 is preferably a double layer capacitor of the type known in the art as an electrochemical capacitor. Suitable capacitors may be obtained from KBI, Lake in the Hills, Ill. under the trade name KAPower. For example, in one alternative embodiment, the capacitor 30 has a capacitance of 1000 farads, a stored energy capacity of 60 kilojoules, an internal resistance at −30 degrees Celsius of 0.003 ohms, and a maximum storage capacity of 17 kilowatts. In general, the capacitor should have a capacitance greater than 150 farads, and an internal resistance at 20° C. that is preferably less than 0.008 ohms, more preferably less than 0.006 ohms, and most preferably less than 0.003 ohms. The energy storage capacity is preferably greater than 15 kJ. Such capacitors provide the advantage that they deliver high currents at low temperatures and relatively low voltages because of their unusually low internal resistance. Further information about suitable capacitors for use in the system of FIGS. 1–8 can be found in publications of ESMA, Troitsk, Moscow region, Russia and on the Internet at www.esma-cap.com. Though not shown in the Figures, the electrical system of the vehicle includes a conventional generator or alternator driven by the engine when running to charge both the batteries 18 and capacitor 30.

The capacitor 30 includes a positive terminal 32 and a negative terminal 34. The positive terminal 32 is connected with the cranking motor via an electrical path 38 that includes a suitable cable and the solenoid switch 20. The negative terminal 34 is connected to system ground 21 by another electrical path 36 that includes suitable cables and a relay 40. The relay 40 includes first and second control terminals 42, 44 and first and second switched terminals 46, 48. The switched terminals 46, 48 are included in the electrical path 36 such that the relay 40 interrupts the electrical path 36 when the relay is in an open-circuit condition. The relay 40 completes the electrical path 36 when the relay is in a closed-circuit condition.

The relay 40 may take many forms, and may include an electromechanical switch or a solid-state switch. By way of example, a 500 amp, 12 volt electromechanical relay can be used such as that supplied by Kissling as part number 29.511.11. As an example of a suitable solid-state relay, the MOSFET switch sold by Intra USA under the trade-name Intra Switch can also be used.

Figure 2:
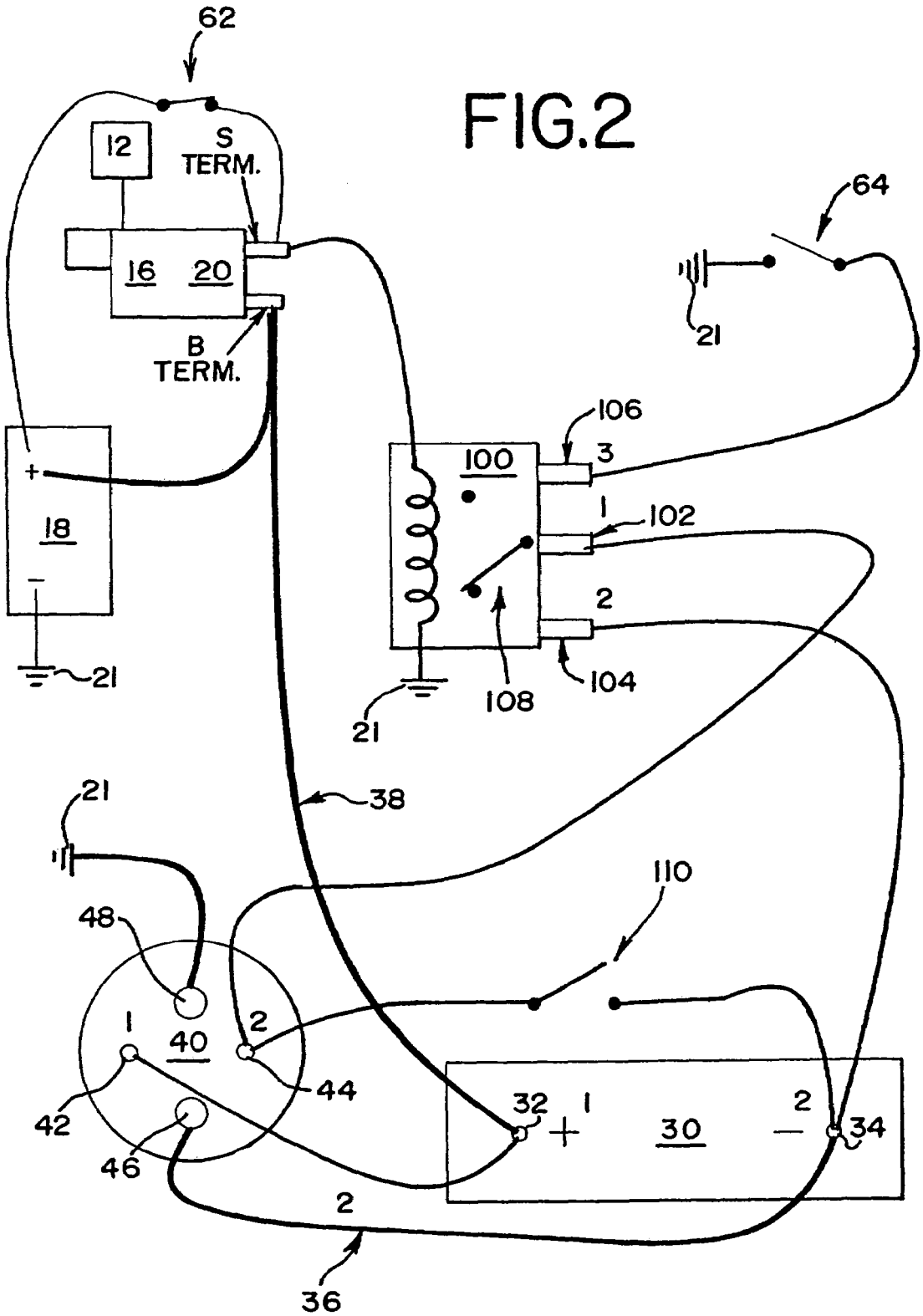
FIG. 2 is a schematic diagram of the system of FIG. 1, with the ignition switch in a closed position, the first relay switch in a second position, the running engine sensory component in the open position and the momentary switch in the open position.

The relay 40 is controlled (e.g., closed) by various control circuits that apply a voltage between the control terminals 42 and 44. In a first embodiment, shown in FIGS. 1–3, the control circuit includes a relay 100 having first, second and third switched terminals 102, 104, 106. One suitable relay is available from Aromat Corp. as part number RK1-6V, which will close in response to a control voltage of at least 4.5 volts being applied thereto. The relay 100 includes a switch 108 moveable between a first and second position in response to a control voltage being applied thereto by the battery 18 when the switch 20 is moved to the closed position, for example when the ignition switch or is moved to the start position as shown in FIGS. 1 and 2. In the first position, the first and third terminals 102, 106 are in a normally closed connection and the first and second terminals 102, 104 are in a normally open connection. In the second position, shown in FIG. 2, the first and second switched terminals 102, 104 are electrically connected or coupled.

Referring to FIGS. 1–4, the first switched terminal 102 (or control terminal) of the relay 100 is electrically coupled to the second control terminal 44 of the relay 40. The second switched terminal 104 of the relay 100 is electrically coupled to the negative terminal 34 of the capacitor 30. Accordingly, and referring to FIG. 2, as the first relay switch 108 is moved to the second position, the capacitor is brought on line to close the second relay. In particular, the capacitor 30 applies a control voltage across the control terminals 42, 44 of the second relay 40 by way of the negative terminal 34 being connected to the control terminal 44 via the first and second switched terminals 102, 104 of the first relay 100 and by way of the positive terminal 32 being connected to the control terminal 42. In this state, the relay 40 connects the negative terminal 34 and system ground 21, thereby connecting the capacitor 30 with the electrical system of the vehicle and making the power stored in the capacitor 30 available for use in engine cranking.

Alternatively, when the ignition switch 62 is in any of the off, on/run or accessory positions, as shown in FIG. 1, the switch 108 of the relay 100 is positioned in the first position. In this condition the relay 100 interrupts the electrical path between the capacitor 30 and the control terminal 44 of the second relay 40, such that the second relay remains open thereby isolating the negative terminal 34 of the capacitor 30 from the cranking motor 16, or other system ground. As such, the capacitor 30 is isolated by the relay 40 from the electrical system of the vehicle, such that it is prevented from discharging. The driver of the vehicle is free to use accessory power as desired, but such usage will at most drain the batteries 18, while leaving the capacitor 30 in a full state of charge.

Figure 3:
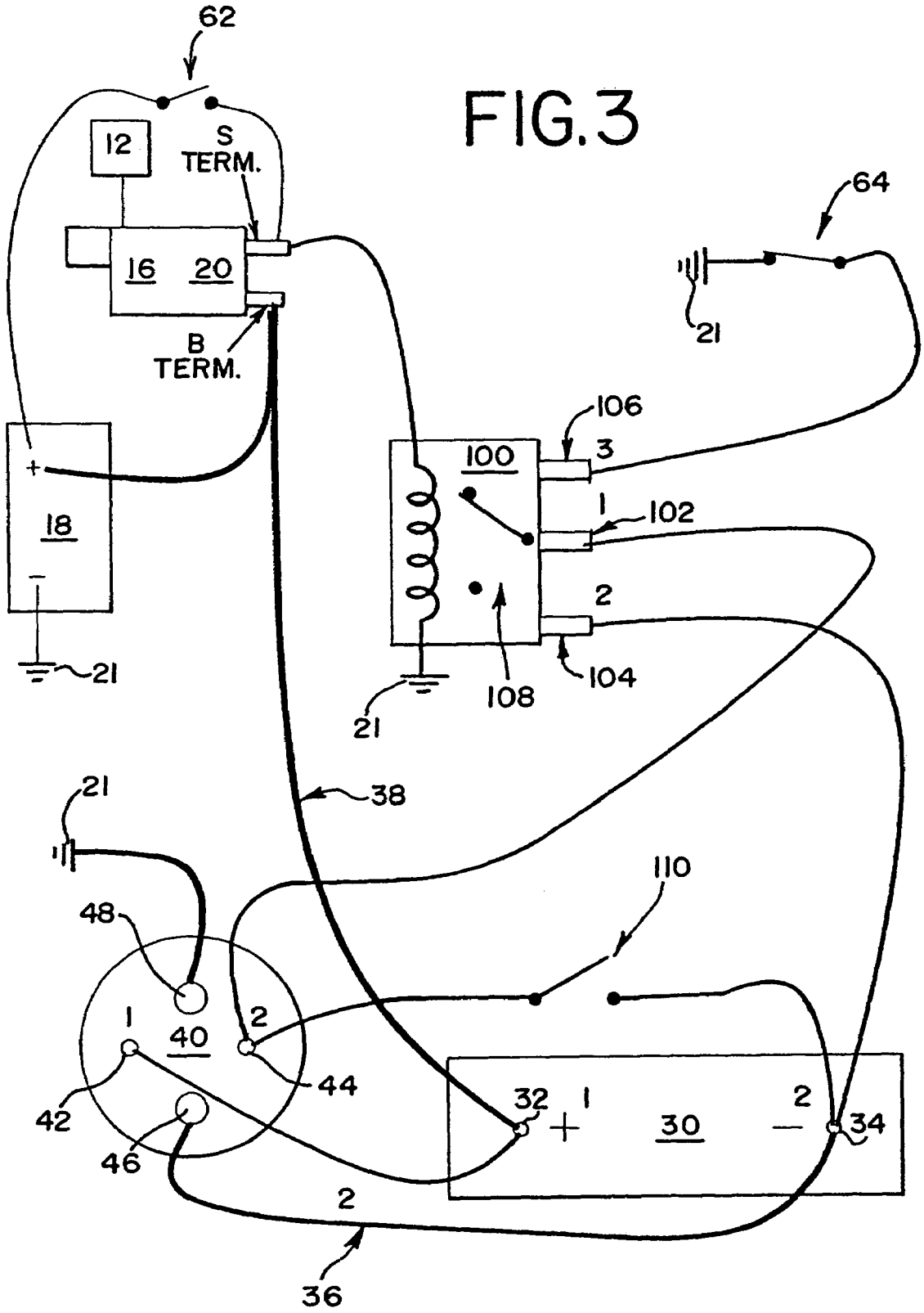
FIG. 3 is a schematic diagram of the system of FIG. 1, with the ignition switch in an open position, the first relay switch in the first position, the running engine sensory component in a closed position and the momentary switch in the open position.

Referring to FIGS. 1–3, the control circuit further includes a running engine sensory component 64 electrically connected between the system ground 21 and the third switched terminal 100 of the first relay 100. As shown in FIG. 3, the running engine sensory component 64 senses that the engine is in a running condition and closes a switch 64 to connect the second relay 40 to ground 21 and thereby keep the second relay 40 in the closed-circuit position.

For example, if the ignition switch 62 is placed in the run position after the engine is started, the relay 100 is not maintained in the closed circuit position by the capacitor since the relay 100 opens thereby disconnecting the first and second switched terminals 102, 104 as the switch moves to the normally opened condition between those terminals. Instead, the second relay 40 is maintained in the closed-circuit position by the running engine sensory component 64 completing the circuit through switched terminals 106, 102. Preferably, the running engine sensory component switch 64 is closed prior to the user placing the ignition switch 62 in the run position. In this way, a voltage is continuously applied across the relay control terminals 42, 44 to maintain the relay 40 in a closed-circuit position, with the control voltage first being applied by the capacitor 30 across the terminals 42, 44 when the first relay switch 108 is in the second position, and thereafter being applied by the capacitor 30, battery 18 and/or alternator by way of the running engine sensory component switch 64 to system ground 21 when the first relay switch 100 is in the first position with the first and third terminals 102, 106 connected in the normally closed condition.

In one embodiment, the running engine sensory component 64 is configured as a normally open oil pressure switch. Various suitable oil pressure switches are available from Nason Co., located in West Union, N.C., for example under Part Nos. SM-2A-5R or SM-2A-10R/WL. When the oil pressure of the engine 12 rises above a set value, or a minimum predetermined value, for example when the engine is running, the normally open oil pressure switch 64 closes, thereby applying a voltage across the control terminals 42, 44 of the second relay. In particular, the control voltage is applied from the battery 18 though the B terminal, electrical path 38, the path between terminals 32 and 42 and from control terminal 44 to the first switched terminal of the first relay to the third switched terminal through the switch and then to system ground 21 through the oil pressure switch. The term "running" as used herein means that the engine crank shaft is turning, for example by way of the cranking motor and/or by way of internal combustion.

In various exemplary preferred embodiments, the minimum predetermined oil pressure is greater than or equal to about 5 psi, alternatively between about 5 psi and about 50 psi, and alternatively between about 10 psi and 30 psi, although it should be understood that it could be a greater or lesser value. When a positive voltage is applied via the conductor to the control terminal 42, this positive voltage places the relay 40 in a closed-circuit condition, which completes the circuit and places the negative terminal 34 in low-resistance contact with the cranking motor 16, or system ground 21. Thus, the oil pressure switch 64 closes the second relay 40 (or maintains the relay in the closed-circuit position) and connects the capacitor 30 to the electrical system including the batteries 18 throughout the time that the engine 12 is running, or until the running engine sensory component, e.g. the oil pressure switch 64, is opened, for example when the engine is turned off and the oil pressure falls below the predetermined minimum oil pressure. This allows the engine alternator (not shown) to recharge the capacitor 30 while the engine is running.

Though not shown in FIGS. 1–8, the electrical system of the vehicle 10 includes a conventional generator or alternator driven by the engine 12 when running to charge both the batteries 18 and the capacitor 30. Thus, the capacitor 30 is generally fully charged when the engine is shut down. Because the relay 40 is in the open-circuit condition, this state of charge of the capacitor 30 is preserved. For this reason, the vehicle operator cannot inadvertently drain the capacitor 30 with auxiliary loads, for example when leaving the ignition switch in the run/on position. The operator of the vehicle is free to use accessory power as desired, regardless of whether the ignition switch is in the run position or the accessory position, and such usage will at most drain the batteries 18, leaving the capacitor 30 in a full state of charge.

Figure 4:
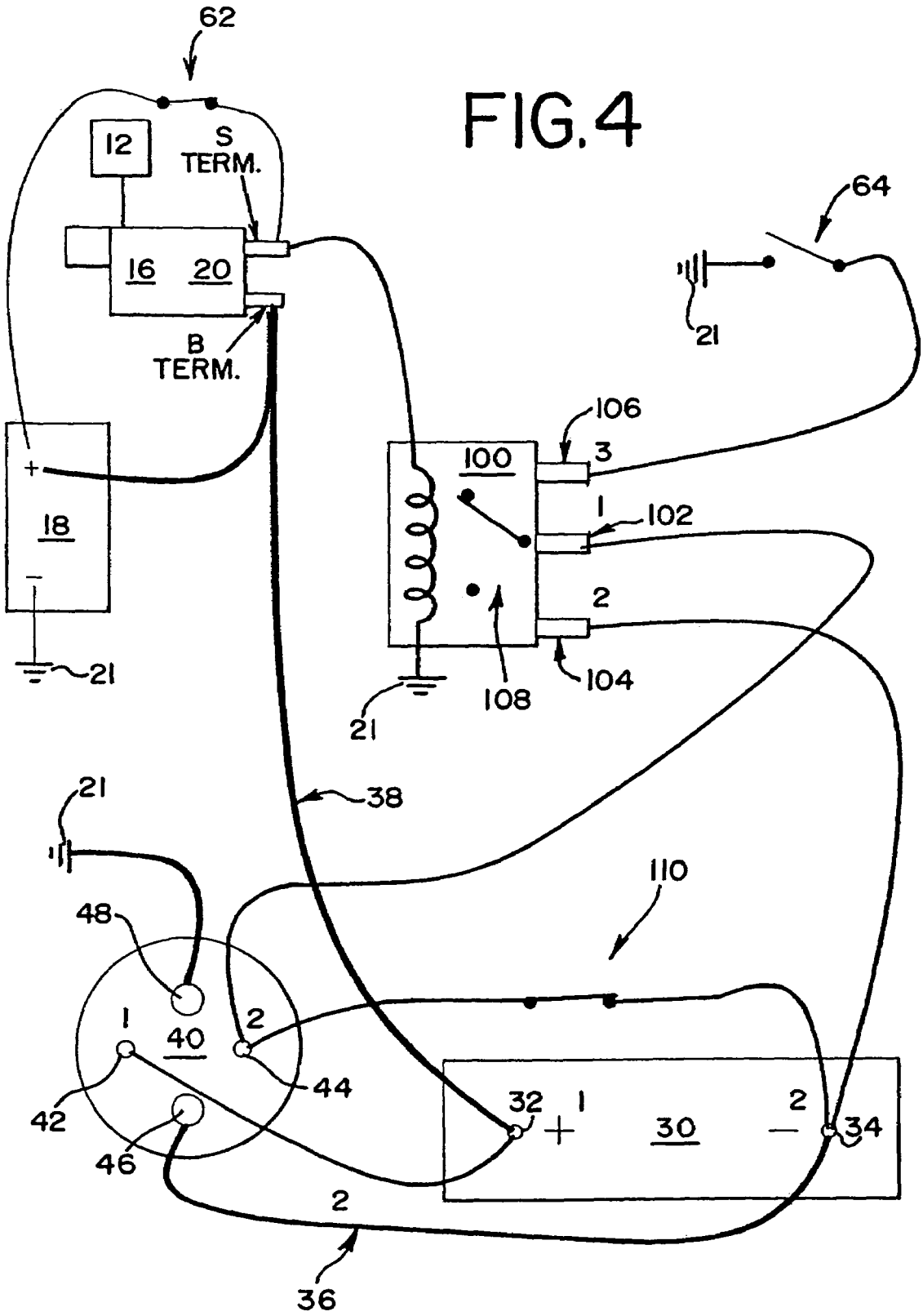
FIG. 4 is a schematic diagram of the system of FIG. 1, with the ignition switch in the closed position, the first relay switch in the first position, the running engine sensory component in the open position and the momentary switch in a closed position.

Referring to FIG. 4, in some situations (for example where the battery has been drained by the driver when the engine is off), the battery may not have enough power or voltage to close the first relay and move the switch to the second position when the ignition switch is moved to the start position. Accordingly, the capacitor cannot be brought on line to close the second relay. In this situation, the operator may actuate a momentary switch 110 connected between the negative terminal 34 of the capacitor and the control terminal 44 of the relay 40. When the momentary switch 110 is closed, the capacitor 30 is brought on line to close the relay 40 and place the capacitor 40 in the electrical path thereby making it available to crank the engine.

Figure 5:
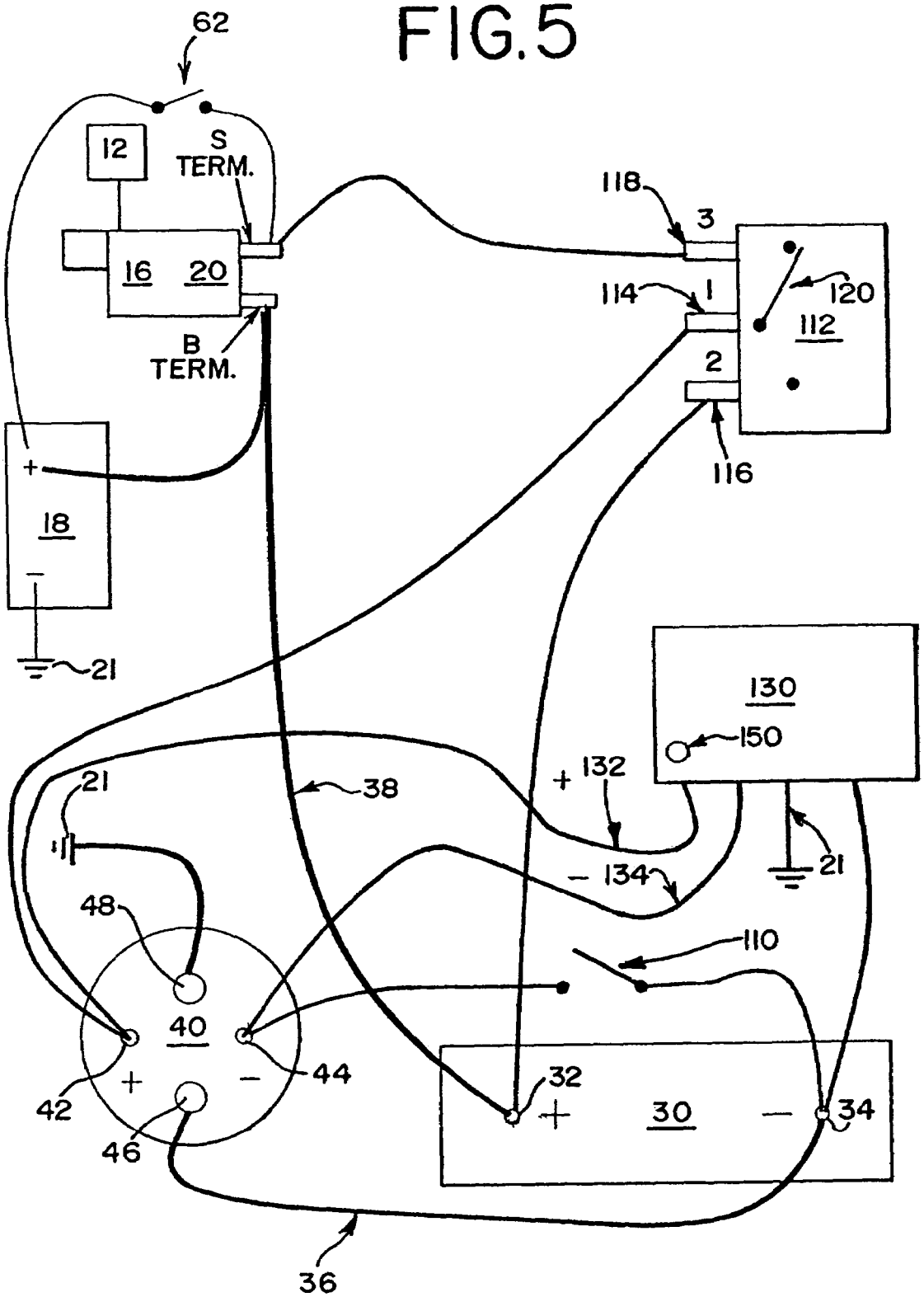
FIG. 5 is a schematic diagram of a second embodiment of a vehicle electrical system, showing an ignition switch in the open position, a running engine sensory component in a first position and a momentary switch in an open position.
Figure 6:
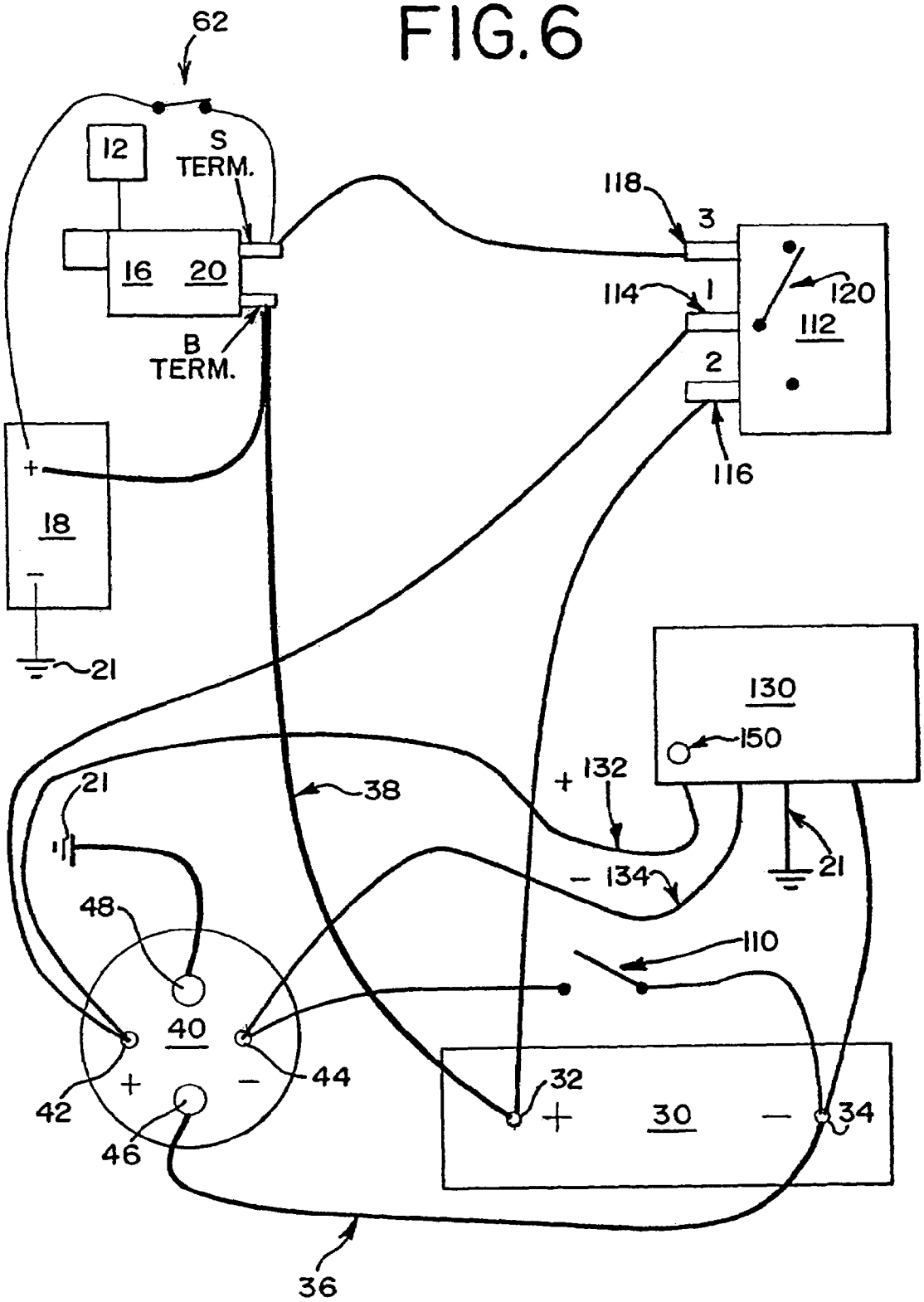
FIG. 6 is a schematic diagram of the system of FIG. 5, with the ignition switch in the closed position, the running engine sensory component in the first position and the momentary switch in the open position.
Figure 7:
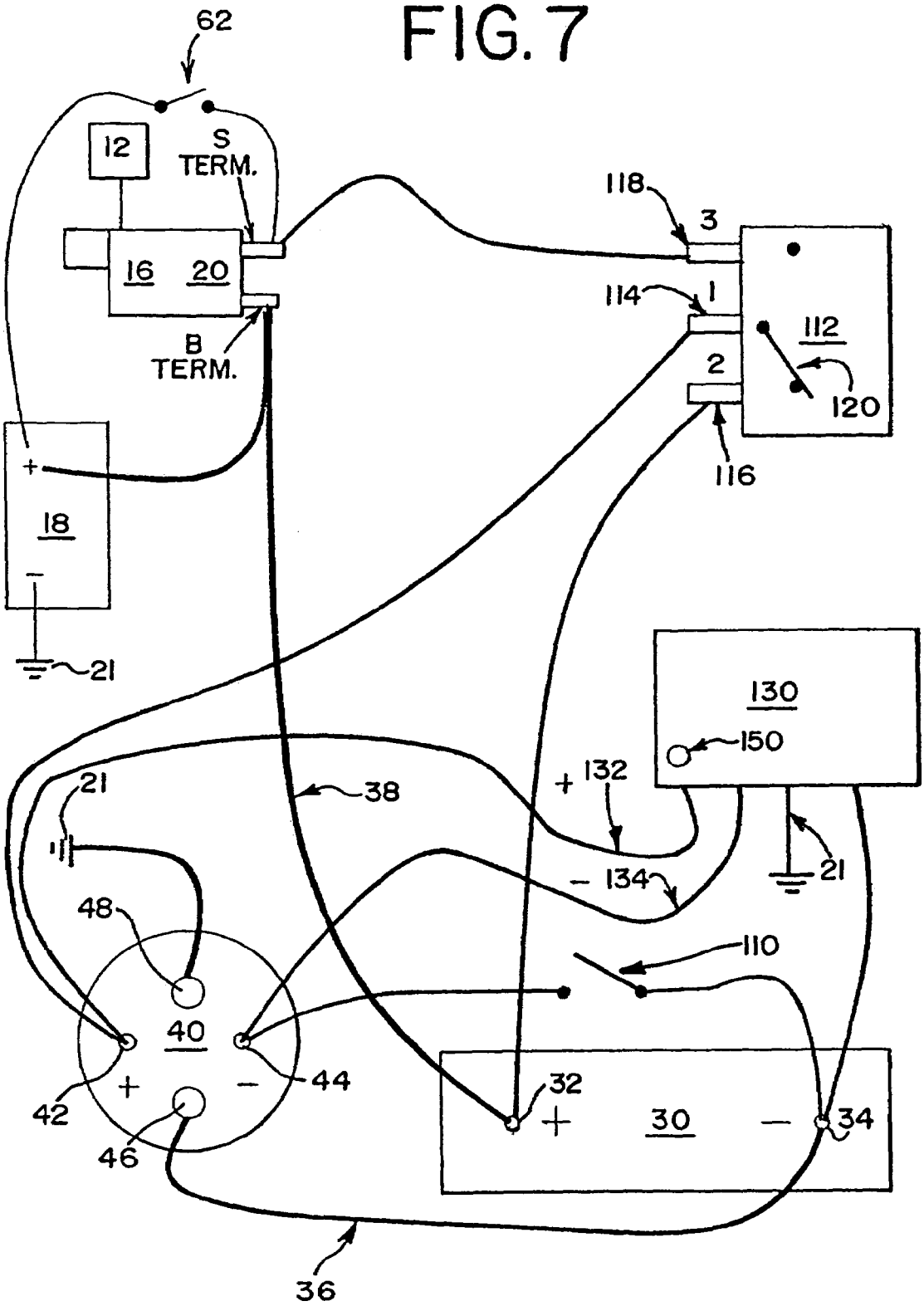
FIG. 7 is a schematic diagram of the system of FIG. 5, with the ignition switch in the open position, the running engine sensory component in a second position and the momentary switch in the open position.

In a second embodiment, shown in FIGS. 5–7, the control circuit includes a running engine sensory component 112 having first, second and third switched terminals 114, 116, 118. The running engine sensory component 112 includes a switch moveable 120 between a first and second position when the engine is operated in a running condition, as shown in FIGS. 6 and 7. In the first position, shown in FIGS. 5 and 6, the first and third switched terminals 114, 118 are electrically connected with the switch 120 in a normally closed condition, and with the switched terminals 114, 116 in the normally open condition. In the second position, shown in FIG. 7, the first and second switched terminals 114, 116 are electrically connected or coupled.

Referring to FIGS. 5–7, the first switched terminal 114 of the running engine sensory component 112 is electrically coupled to the first control terminal of the relay 40, and the second switched terminal 116 of the running engine sensory component is electrically coupled to the positive terminal 32 of the capacitor 30.

An electronic capacitor control module (ECCM) 130 is electrically coupled to each of the first and second control terminals 42, 44 of the relay 40 along input and output paths 132, 134 respectively. The control module is further electrically coupled to system ground 21 and to the negative terminal 34 of the capacitor. One suitable control module is available from Kold Ban International, Ltd., the assignee of the present application, as part number KBI 302160.

In operation, and referring to FIG. 6, the ignition switch 62 is closed such that the battery 18 applies a voltage that is measured by the control module 130. The voltage is applied to the control terminal 42 of the relay 40 via the third and first switched terminals 118, 114 and to the control module 130 by way of the input line 132, with the control module being grounded. If the voltage applied by the battery 18 is greater than or equal to a minimum predetermined voltage, the control module 130 connects the second control terminal 44 with the capacitor terminal 34 and the capacitor 30 applies a control voltage to close the relay 40. In various embodiments, the minimum predetermined voltage is greater than or equal to about 3 volts, greater than or equal to about 4 volts, or between about 3 and 4 volts. As such, the control module 130 can detect whether the operator is attempting to crank the engine by virtue of the voltage being measured by the control module. If a cranking attempt is being made, the control module 130 brings the capacitor 30 on line to close the relay 40 and bring the capacitor on line to crank the engine.

When the ignition switch 62 is in any of the off, on/run or accessory positions, as shown in FIG. 5, the battery 18 is isolated from the control module 130, such that no control voltage is applied to or measured by the control module. In this condition, the relay 40 remains open thereby isolating the negative terminal 34 of the capacitor 30 from the cranking motor 16, or other system ground. As such, the capacitor 30 is isolated from the relay 40 and engine electrical system, such that it is prevented from discharging. The driver of the vehicle is free to use accessory power as desired, but such usage will at most drain the batteries 18, while leaving the capacitor 30 in a full state of charge.

Referring to FIG. 7, the running engine sensory component 64 senses that the engine 12 is in a running condition and moves the switch 120 from the first position to the second position so as to electrically connect the first and second switched terminals 114, 116. In this second position, capacitor is electrically coupled to the first control terminal 42 of the relay 40 by way of the first and second switched terminals 114, 116. The control module in turn couples the negative terminal 34 of the capacitor with the second control terminal 44 so as to apply a voltage across the control terminals 42, 44 with the capacitor 30 and battery 18 (in parallel with the capacitor) and maintain the relay in a closed-circuit position. This allows the engine alternator (not shown) to recharge the capacitor 30.

When the control module 130 is sending power to the relay 40, a sensory cue is provided to the operator on the control module. In one embodiment, the sensory cue is a visual cue 150, including for example a light (e.g., a LED readout). The visual cue 150 could alternatively be a digital or analog cue, for example a readout as to the voltage or a text message. The sensory cue could also be an audible cue, such as a tone or beeping, or could provide a voice message. Alternatively, the sensory cue could be a vibration or other tactile cue. Of course, the sensory cue could be a combination of the various aforementioned cues, for example a combined visual and auditory cue. In addition, it should be understood that no cue need be provided.

In one embodiment, the running engine sensory component 64 is configured as a two-pole, normally open, normally closed, oil pressure switch. Various suitable oil pressure switches are available from Nason Co., located in West Union, N.C., for example under Part Nos. SM-2C-10R/WL or SM-2C-30R/WL. When the oil pressure of the engine 12 rises above a set value, or a minimum predetermined value, for example when the engine is running, the normally open oil pressure switch 64 moves to the second position thereby closing the normally open pole. The term "running" as used herein means that the engine crank shaft is turning, for example by way of the cranking motor and/or by way of internal combustion.

In various exemplary preferred embodiments, the minimum predetermined oil pressure is greater than or equal to about 5 psi, alternatively between about 5 psi and about 50 psi, and alternatively between about 10 psi and 30 psi, although it should be understood that it could be a greater or lesser value.

Though not shown in FIGS. 5–8, the electrical system of the vehicle 10 includes a conventional generator or alternator driven by the engine 12 when running to charge both the batteries 18 and the capacitor 30. Thus, the capacitor 30 is generally fully charged when the engine is shut down. Because the relay 40 is in the open-circuit condition when the engine is turned off, this state of charge of the capacitor 30 is preserved. For this reason, the vehicle operator cannot inadvertently drain the capacitor 30 with auxiliary loads, for example when leaving the ignition switch in the run/on position. The driver of the vehicle is free to use accessory power as desired, regardless of whether the ignition switch is in the run position or the accessory position, and such usage will at most drain the batteries 18, leaving the capacitor 30 in a full state of charge.

Figure 8:
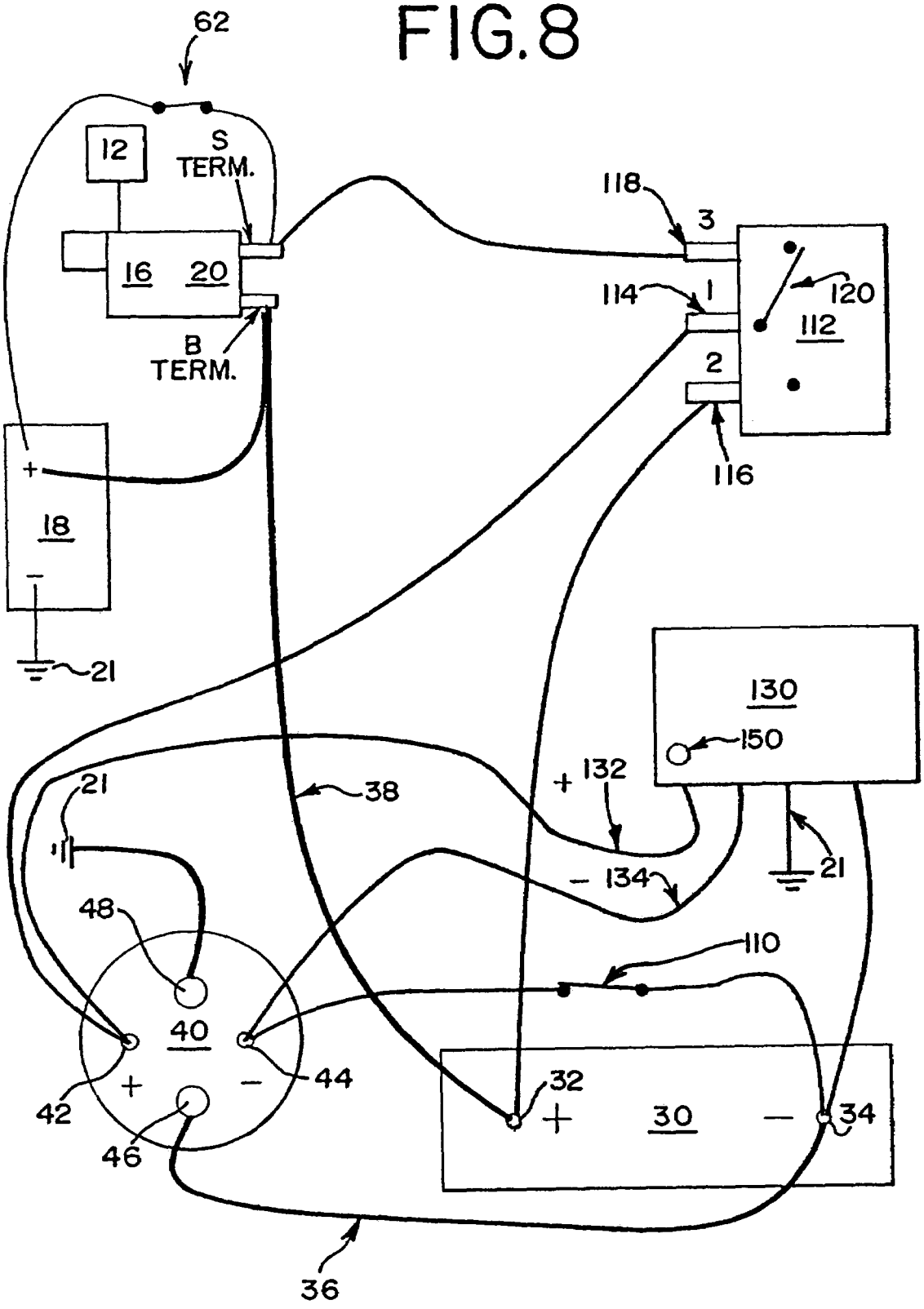
FIG. 8 is a schematic diagram of the system of FIG. 5, with the ignition switch in the closed position, the running engine sensory component in the first position and the momentary switch in a closed position.

Referring to FIG. 8, in some situations (for example where the battery has been drained by the driver when the engine is off), the battery may not have enough power or voltage to meet the predetermined minimum level measured by the control module. In this situation, the control module 130 senses that the voltage has not met the minimum predetermined value and the control module will not bring the capacitor on line to close the relay. Instead, the driver can actuate a momentary switch 110 connected between the terminal 34 of the capacitor and the control terminal 44 of the relay 40. When the momentary switch 110 is closed, the capacitor 30 is brought on line to close the relay 40 and place the capacitor 30 in the electrical path thereby making it available to crank the engine.

The systems described above provide a number of important advantages. The supplemental electrical systems including the capacitor 30 provides adequate current for reliable engine starting, even if the batteries 18 are substantially discharged by auxiliary loads when the engine 12 is not running. The capacitor 30 is automatically disconnected from the vehicle electrical system when the vehicle is turned off, and automatically reconnected to the vehicle electrical system when the engine is started. If needed, the capacitor 30 can be brought on line with a momentary switch 110 to provide cranking power.

Additionally, the capacitor 30 provides the advantage that it can be implemented with an extremely long-life device that can be charged and discharged many times without reducing its efficiency in supplying adequate cranking current. This system does not interfere with conventional availability of the batteries 18 to power accessories when the engine is off. This reduces the incentive of the vehicle operator to defeat the system.

Referring to the embodiments of FIGS. 1–8, the control system is powered with the stored voltage on the capacitor 30 and/or the batteries 18. Thus, as long as the capacitor 30 includes an adequate charge to start the engine 12, it will provide an adequate voltage to close the relay 40.

As used herein, the terms "connected" and "coupled with" are intended broadly to encompass direct and indirect coupling. Thus, first and second elements are said to be coupled with one another whether or not a third, unnamed, element is interposed therebetween. For example, two elements may be coupled with one another by means of a switch.

The term "battery" is intended broadly to encompass a set of batteries including one or more batteries.

The term "set" means one or more.

The term "path" is intended broadly to include one or more elements that cooperate to provide electrical interconnection, at least at some times. Thus, a path may include one or more switches or other circuit elements in series with one or more conductors.

Of course, many alternatives are possible. For example, the relay can be placed in the electrical path that interconnects the positive terminal of the capacitor and the cranking motor or in both electrical paths that interconnect with the capacitor. Various switches and relays can be used to implement the functions described above, and cables and cable terminations can be adapted as appropriate. For example, it is not essential in all embodiments that an engine oil pressure switch be used to indicate when the engine is running. Rather, as explained above, other parameters indicative of engine operation can be used to control the switch 64, 120 including without limitation alternator output, flywheel rotation, manifold pressure/vacuum and/or ECM signals.

The foregoing description has discussed only a few of the many forms that this invention can take. For this reason, this detailed description is intended by way of illustration, not limitation. It is only the claims, including all equivalents, that are intended to define the scope of this invention.

The invention claimed is:

1. An engine cranking system comprising:

an engine operably moveable between a running condition and an off condition;

a cranking motor coupled to said engine;

a battery comprising first and second battery terminals, said first battery terminal electrically coupled to said cranking motor and said second battery terminal electrically coupled to a system ground;

a capacitor comprising first and second capacitor terminals;

first and second electrical paths interconnecting said first and second capacitor terminals, respectively, with said cranking motor and said system ground;

an ignition switch coupled between said first battery terminal and said cranking motor, said ignition switch completing an electrical path between said first battery terminal and said cranking motor when moved to a start position;

a running engine sensory component comprising a first switched terminal, a second switched terminal and a third switched terminal, said running engine sensory component comprising a switch moveable from a first position to a second position when said engine is operated in said running condition, wherein said first and third switched terminals are electrically coupled when said switch is in said first position, and wherein said first and second switched terminals are electrically coupled when said switch is in said second position;

a relay included in one of said first and second electrical paths and having a first control terminal and a second control terminal, wherein said second relay is moveable between at least an open-circuit condition and a closed-circuit position in response to a control voltage being applied thereto across said first and second control terminals, wherein said relay interrupts said one of said first and second electrical paths when in said open-circuit position, and wherein said relay completes said one of said first and second electrical paths when in said closed-circuit position; and a control module electrically coupled to each of said first and second control terminals of said relay, wherein said control module is electrically coupled to at least one of said first and second capacitor terminals, wherein said control module is operable to measure a voltage applied by said battery when said ignition switch is in the start position and said switch of said running engine sensory component is in said first position and to electrically couple said capacitor with said relay if said voltage is greater than or equal to a minimum predetermined voltage, and wherein said control module is operable to electrically couple at least one of said capacitor and said battery with said relay when said switch of said running engine sensory component is in said second position.

2. The engine cranking system of claim 1 wherein said battery and said capacitor are electrically coupled in parallel with said relay when said switch of said running engine sensory component is in said second position.

3. The engine cranking system of claim 1 wherein said control module is operable to electrically couple said second control terminal of said relay with second capacitor terminal if said voltage is greater than or equal to said minimum predetermined voltage, and wherein said control module is operable to maintain the electrical coupling between said second control terminal of said relay with said second capacitor terminal when said switch of said running engine sensory component is in said second position.

4. The engine cranking system of claim 3 wherein said relay is included in said second electrical path.

5. The engine cranking system of claim 1 wherein said running engine sensory component comprises an oil pressure switch, wherein said oil pressure switch is positionable in said second position in response to at least a predetermined minimum oil pressure being applied thereto.

6. The engine cranking system of claim 5 wherein said predetermined minimum pressure is greater than or equal to about 5 psi.

7. The engine cranking system of claim 1 further comprising a momentary switch electrically coupled between one of said first and second capacitor terminals and one of said first and second control terminals of said relay, said momentary switch moveable between an open position and a closed position, wherein said momentary switch completes the electrical path between said one of said first and second capacitor terminals and said one of said first and second control terminals of said relay when in said closed position.

8. The engine cranking system of claim 7 wherein said momentary switch is electrically coupled between said second capacitor terminal and said second control terminal of said relay.

9. The engine cranking system of claim 1 wherein said capacitor comprises a double layer capacitor characterized by a capacitance greater than about 150 farads and an internal resistance at 20° C. less than about 0.008 ohms.

10. The engine cranking system of claim 1 wherein said first switched terminal of said running engine sensory component is electrically coupled to said first control terminal of said relay and wherein said control module is electrically coupled to said second capacitor terminal, and wherein said first terminal of said capacitor is electrically coupled to said first control terminal of said relay through said first battery terminal, said ignition switch and said third and first switched terminals of said running engine sensory component when said running engine sensory component is in said first position.

11. The engine cranking system of claim 1 wherein said first capacitor terminal is electrically coupled to said second switched terminal of said running engine sensory component.

* * * * *